US011189928B2

(12) United States Patent
Rabah

(10) Patent No.: US 11,189,928 B2
(45) Date of Patent: Nov. 30, 2021

(54) TECHNIQUE FOR TUNING THE RESONANCE FREQUENCY OF AN ELECTRIC-BASED ANTENNA

(71) Applicant: AIRSPAN IP HOLDCO LLC, Boca Raton, FL (US)

(72) Inventor: Hassanein Daniel Rabah, Slough (GB)

(73) Assignee: AIRSPAN IP HOLDCO LLC, Boca Raton, FL (US)

( * ) Notice: Subject to any disclaimer, the term of this patent is extended or adjusted under 35 U.S.C. 154(b) by 222 days.

(21) Appl. No.: 16/374,280

(22) Filed: Apr. 3, 2019

(65) Prior Publication Data

US 2019/0334243 A1 Oct. 31, 2019

(30) Foreign Application Priority Data

Apr. 26, 2018 (GB) ..... 1806844

(51) Int. Cl.
*H01Q 9/04* (2006.01)
*H01Q 1/48* (2006.01)

(52) U.S. Cl.
CPC ..... *H01Q 9/0442* (2013.01); *H01Q 1/48* (2013.01); *H01Q 9/0421* (2013.01)

(58) Field of Classification Search
CPC ..... H01Q 9/42; H01Q 9/0442; H01Q 9/145
See application file for complete search history.

(56) References Cited

U.S. PATENT DOCUMENTS 6,218,992 B1 4/2001 Sadler et al.
2004/0227672 A1 11/2004 Chen et al.
2005/0264458 A1* 12/2005 Takagi ..... H01Q 9/42 343/702

(Continued)

FOREIGN PATENT DOCUMENTS

JP H0522018 A 1/1993
WO 2010061047 A1 6/2010

OTHER PUBLICATIONS

PCT Search Report and Written Opinion from PCT/GB2019/050895 dated Jun. 14, 2019, 18 pages.
GB Search Report from GB1806844.5 dated Sep. 10, 2018, 4 pages.

*Primary Examiner* — Ricardo I Magallanes
(74) *Attorney, Agent, or Firm* — Andrew L. Dunlap; Haynes Beffel & Wolfeld LLP

(57) ABSTRACT

A technique is provided for tuning the resonance frequency of an electric-based antenna formed by a radiator element coupled to an antenna ground plane. The disclosed method comprises providing a plurality of parasitic capacitive elements extending in an electric field direction of the electric-based antenna so as to lower the resonance frequency of the electric-based antenna below a desired resonance frequency. The electric-based antenna is then integrated within a deployment environment of interest, and thereafter an indication of an actual frequency response of the electric-based antenna within the deployment environment is obtained. One or more of the parasitic capacitive elements may then be removed so as to adjust the actual resonance frequency towards the desired resonance frequency. By such an approach, a significant degree of adjustment in the resonance frequency of the antenna can be made after the antenna has been integrated within the deployment environment.

16 Claims, 6 Drawing Sheets

(56) References Cited

U.S. PATENT DOCUMENTS

| | | | | |
|---|---|---|---|---|
| 2007/0229366 | A1 | 10/2007 | Kim et al. | |
| 2009/0153414 | A1 | 6/2009 | Hsieh et al. | |
| 2011/0128200 | A1 | 6/2011 | Hossain et al. | |
| 2011/0205138 | A1* | 8/2011 | Yanagi | H01Q 9/42 343/845 |
| 2013/0076574 | A1* | 3/2013 | Rappoport | H01Q 1/243 343/702 |
| 2013/0154888 | A1 | 6/2013 | Lin et al. | |
| 2013/0249765 | A1 | 9/2013 | Su | |
| 2014/0191918 | A1* | 7/2014 | Cheng | H01Q 21/205 343/834 |
| 2017/0062953 | A1 | 3/2017 | Teshima et al. | |

* cited by examiner

TECHNIQUE FOR TUNING THE RESONANCE FREQUENCY OF AN ELECTRIC-BASED ANTENNA

BACKGROUND

The present disclosure relates to a technique for tuning the resonance frequency of an electric-based antenna.

Electric-based antennas (also referred to as resonant antennas) are a common form of antenna design, and are based on the resonance principle. In particular, the resonance principle relies on the behaviour of moving electrons, which reflect off surfaces where the dielectric constant changes. In an electric-based antenna design, the reflective surface may be created by the end of a radiator element, typically a thin metal wire, and in operation such behaviour creates a standing wave at the resonance frequency. At the resonance frequency, an antenna presents only active energy and zero reactive energy. For an electric-based antenna the reactive energy is capacitive before the resonance and inductive after the resonance.

The antenna response of such an electric-based antenna is affected by the deployment environment in which the antenna is used. There is a desire for systems incorporating such antennas to be ever more compact, and cheap to manufacture. Due to the ever increasing need for more compact designs, it is often the case that an electric-based antenna is positioned in close proximity to other components of the device incorporating the antenna. Interaction with nearby dielectrics such as plastic covers, or with metal structures such as other electronic components or other antenna devices operating in different frequency bands within the device, can all have a significant effect on the antenna response of an electric-based antenna. Accordingly, it is desirable to be able to tune the resonance frequency of an electric-based antenna to take account of the deployment environment in which it is used. However, it is also necessary for the antenna design to be simple, so as to allow for cost effective manufacture.

SUMMARY

In a first example arrangement, there is provided a method of tuning a resonance frequency of an electric-based antenna formed by a radiator element coupled to an antenna ground plane, comprising: providing a plurality of parasitic capacitive elements extending in an electric field direction of the electric-based antenna so as to lower the resonance frequency of the electric-based antenna below a desired resonance frequency; integrating the electric-based antenna within a deployment environment; obtaining an indication of an actual resonance frequency of the electric-based antenna within the deployment environment; and removing one or more of the parasitic capacitive elements so as to adjust the actual resonance frequency towards the desired resonance frequency.

In another example configuration, there is provided an apparatus comprising: an antenna ground plane; a radiator element coupled to the antenna ground plane so as to form an electric-based antenna having an electric field direction between the radiator element and the antenna ground plane; and at least one parasitic capacitive element, each parasitic capacitive element extending from the ground plane in the electric field direction towards the radiator element and serving to influence a resonance frequency of the electric-based antenna.

In a yet further example configuration, there is provided an apparatus comprising: at least one electric-based antenna comprising a radiator element coupled to an antenna ground plane, the antenna ground plane being shared with each electric-based antenna; each electric-based antenna being provided with a plurality of parasitic capacitive elements extending in an electric field direction of that electric-based antenna so as to lower the resonance frequency of that electric-based antenna below a desired resonance frequency; wherein each of the plurality of parasitic capacitive elements is individually removable such that, when the apparatus is integrated within a deployment environment, a method of tuning each electric-based antenna may be performed by obtaining an indication of an actual resonance frequency of that electric-based antenna within the deployment environment, and removing one or more of the parasitic capacitive elements so as to adjust the actual resonance frequency towards the desired resonance frequency.

BRIEF DESCRIPTION OF THE DRAWINGS

The present technique will be described further, by way of illustration only, with reference to examples thereof as illustrated in the accompanying drawings, in which.

DESCRIPTION OF EXAMPLES

Figure 1:
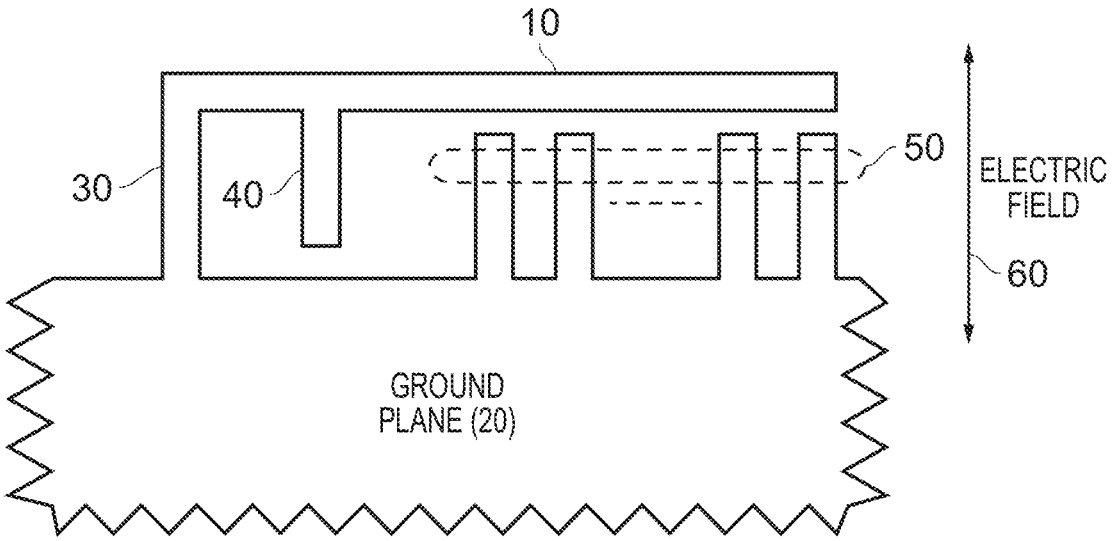
FIG. 1 is a diagram schematically illustrating an electric-based antenna in accordance with one example.

In accordance with the techniques described herein, a method for tuning the resonance frequency of an electric-based antenna is provided. The electric-based antenna is formed by a radiator element coupled to an antenna ground plane, and the method comprises providing a plurality of parasitic capacitive elements extending in an electric field direction of the electric-based antenna (the electric field direction being the direction of the dominant component of the electric field) so as to lower the resonance frequency of the electric-based antenna below a desired resonance frequency. In particular, the presence of the parasitic capacitive elements creates a capacitive effect which biases the antenna element towards storing more electrical energy than magnetic energy, and as a result lowers the resonance frequency of the antenna relative to an equivalent design that did not include the parasitic capacitive elements. The aim is to provide a number of parasitic capacitive elements sufficient to ensure that the resonance frequency is below the desired resonance frequency.

In accordance with the described technique, the electric-based antenna is then integrated within a deployment environment. As mentioned earlier, the antenna response will typically be affected by the deployment environment, and in many modern devices that incorporate such electric-based antennas, there can be a number of surrounding features of the deployment environment that alter the antenna response.

These can include nearby dielectric materials, such as plastic covers and the like, or other metal components such as electronic components provided within the device, or indeed other antenna systems provided within the device that may be operating in different frequency bands. The presence of the parasitic capacitive elements can be used to provide a mechanism for post-tuning the radiator element after integration into such a complex environment, having regards to the desired resonance frequency.

In particular, by monitoring the electric-based antenna within the deployment environment, an indication of its actual frequency response can be obtained. In accordance with the techniques described herein, one or more of the parasitic capacitive elements can then be removed so as to adjust the actual resonance frequency towards the desired resonance frequency. In particular, as each parasitic capacitive element is removed, the resonance frequency will increase, and accordingly by removing a certain number of parasitic capacitive elements taking into account both the desired resonance frequency and the actual resonance frequency, it is possible to adjust the actual resonance frequency so as to result in an actual resonance frequency that is close to the desired resonance frequency.

It has been found that by such an approach, it is possible to provide a significant range of adjustment in the resonance frequency of the electric-based antenna, enabling a tuning of the antenna to be performed to take account of a wide variety of factors that may be present within the deployment environment, and each of which may have an effect on the resonance frequency of the antenna.

In one example implementation, the plurality of parasitic capacitive elements provided is such that the removing step enables the resonance frequency to be increased by up to a chosen maximum percentage between a configuration with all of the parasitic capacitive elements remaining and a configuration within no parasitic capacitive elements remaining. The percentage change that can be made in the resonance frequency as a result of removing parasitic capacitive elements will vary dependent on implementation, for example based on the number of parasitic capacitive elements provided, and the gaps between the parasitic capacitive elements and the radiator element, but it has been found that in a number of example use cases the resonance frequency can be increased by 40 to 50 percent relative to the starting resonance frequency when all of the parasitic capacitive elements are in place. This provides a very useful range of adjustment in the resonance frequency of the antenna.

In one example arrangement the radiator element is shorted to the antenna ground plane at a shorting location, and the plurality of parasitic capacitive elements are positioned so that they are at different distances from the shorting location. In addition to the number of parasitic capacitive elements that are removed, the degree to which the resonance frequency is adjusted can be altered depending on whether capacitive elements closer to the shorting location or further from the shorting location are removed. This hence provides a great deal of flexibility in the adjustments made to the resonance frequency.

The radiator element can be arranged in a variety of ways but in one example configuration is formed so to be coplanar with the antenna ground plane. This provides a particularly compact and area efficient design. Further, since the radiator element is formed so as to be coplanar with the antenna ground plane, the electric field direction is coplanar with the antenna ground plane. As a result, such an antenna design can be readily incorporated within a device that also incorporates other types of antenna that have their electric field polarisation perpendicular to the ground plane.

In one example configuration, a feed point is provided into the radiator element that is also coplanar with the antenna ground plane. Again, this can lead to a very efficient and compact design.

Furthermore, during the step of providing the plurality of parasitic capacitive elements, each parasitic capacitive element can be formed so as to be coplanar with the antenna ground plane. Accordingly, all of the key components of the antenna can be formed so as to be coplanar with the antenna ground plane, providing a very space efficient design.

There are a number of ways in which the radiator element and each parasitic capacitive element (and indeed the feed point) can be formed. However, in one example arrangement, the antenna ground plane is provided by a conductive sheet, and the radiator element and each parasitic capacitive element are formed from the conductive sheet. If desired, the feed point pin can also be formed from the conductive sheet. Hence, all of the key components of the antenna can be formed directly out of the conductive sheet that is used to provide the antenna ground plane, thereby significantly simplifying the design, and reducing the number of separate components, thus facilitating cost savings while also reducing complexity.

The conductive sheet that is used to provide the antenna ground plane can take a variety of forms, and can be of any arbitrary shape, for example to take into account the positioning and shape of the other components that are to be provided within the device incorporating the antenna.

Whilst the above described tuning technique can be applied in respect of a single instance of an electric-based antenna constructed in the manner discussed earlier, in one example arrangement multiple instances of the electric-based antenna may be provided that each share the antenna ground plane and have an associated radiator element. Within such an arrangement, the method may further comprise, for each electric-based antenna, providing a plurality of parasitic capacitive elements extending in an electric field direction of that electric-based antenna so as to lower the resonance frequency of that electric-based antenna below a desired resonance frequency of that electric-based antenna. On integrating the plurality of electric-based antennas within the deployment environment, the method may then comprise tuning the resonance frequency of each electric based antenna by, for each electric-based antenna: obtaining an indication of an actual resonance frequency of that electric-based antenna within the deployment environment; and removing one or more of the parasitic capacitive elements of that electric-based antenna so as to adjust the actual resonance frequency towards the desired resonance frequency of that electric-based antenna. By such an approach, multiple antennas can be readily incorporated within a device, in a compact and efficient way, and each of those antennas can be individually tuned once located within the deployment environment, so as to allow the resonance frequency of each antenna to be adjusted towards the desired resonant frequency of that antenna.

There are a number of ways in which the plurality of electric-based antennas could be accommodated within such a design, but in one example arrangement the radiator elements of the plurality of electric-based antennas are distributed around a peripheral edge of the antenna ground plane. This can lead to a particularly space efficient design.

Further, it enables the antennas to be grouped together if desired. For example, the plurality of electric-based antennas may form a first group of antennas and a second group of antennas, where the first group has an electric field direction orthogonal to the electric field direction of the second group. This enables additional flexibility in the way in which the antennas are configured for use within the device.

In one particular proposed implementation, the plurality of electric-based antennas may comprise eight electric-based antennas, and an overall dimension of the eight electric-based antennas including the shared antenna ground plane is approximately $0.6x\lambda_0$ by $0.4x\lambda_0$, where $\lambda_0$ is a wavelength corresponding to a chosen resonance frequency. This provides a particularly compact design where the overall area required within the plane of the antenna ground plane is constrained by a particular wavelength that corresponds to a chosen resonance frequency. The chosen resonance frequency may be the desired resonance frequency assuming all of the antennas have the same desired resonance frequency. However, alternatively, the wavelength that constrains the size may be the wavelength that corresponds to the lowest desired resonance frequency, in situations where not all of the antennas have the same desired resonance frequency.

In one example arrangement, due to the plurality of electric-based antennas being distributed around the peripheral edge of the antenna ground plane, it is possible to employ the antenna ground plane as a ground plane for other antennas in addition to the plurality of electric-based antennas. For example, the ground plane can also be used in association with other antennas that may have an electric field direction perpendicular to the ground plane.

The electric-based antenna can take a variety of forms, but in one example configuration is an inverted-F antenna. An inverted-F antenna consists of a monopole antenna running parallel to the ground plane and grounded at one end. The antenna is then fed from an intermediate point a distance from the grounded end. Such an antenna can be constructed to be significantly shorter and more compact than standard monopole antennas.

In one particular example arrangement, the electric-based antenna is a metallic inverted-F antenna. In particular, in one example configuration the various components of the electric-based antenna are formed from the same metallic sheet that is used to provide the ground plane, providing a particularly space saving and cost effective implementation.

In one example arrangement, all of the necessary adjustments to the resonance frequency are performed by removal of one or more of the parasitic capacitive elements. However, if desired, the method may further comprise reducing the length of the radiator element in combination with removal of one or more of the parasitic capacitive elements when adjusting the actual resonance frequency towards the desired resonance frequency. This can provide a further degree of fine tuning in the adjustment of the resonance frequency. It should be noted however that there is no requirement to allow for adjustment in the length of the radiator element, and by use of an appropriate number of parasitic capacitive elements a sufficient level of adjustment in the actual resonance frequency can typically be provided. In particular, whilst it may not always be possible to adjust the actual resonance frequency so that it directly matches the desired resonance frequency, it has been found that the actual resonance frequency can be adjusted to a point where it is near enough to the desired resonance frequency to allow the antenna to operate well within the deployment environment.

Once the above described tuning method has been applied in order to remove one or more of the parasitic capacitive elements so as to adjust the actual resonance frequency towards the desired resonance frequency, then the resulting final design can be used as a blueprint for manufacturing a large number of devices conforming to that design.

By use of such tuning techniques, an apparatus can hence be produced that comprises: an antenna ground plane; a radiator element coupled to the antenna ground plane so as to form an electric-based antenna having an electric field direction between the radiator element and the antenna ground plane; and at least one parasitic capacitive element, each parasitic capacitive element extending from the ground plane in the electric field direction towards the radiator element and serving to influence a resonance frequency of the electric-based antenna. In particular, such an apparatus may be manufactured to incorporate at least one antenna produced as a result of the above described tuning process, where that antenna has at least one parasitic capacitive element remaining after tuning has been performed, and hence that at least one remaining parasitic capacitive element influences the resonance frequency of the electric-based antenna.

An apparatus can also be produced as a starting point for performance of the above described tuning technique. In particular, such an apparatus may comprise: at least one electric-based antenna comprising a radiator element coupled to an antenna ground plane, the antenna ground plane being shared with each electric-based antenna; each electric-based antenna being provided with a plurality of parasitic capacitive elements extending in an electric field direction of that electric-based antenna so as to lower the resonance frequency of that electric-based antenna below a desired resonance frequency; wherein each of the plurality of parasitic capacitive elements is individually removable such that, when the apparatus is integrated within a deployment environment, a method of tuning each electric-based antenna may be performed by obtaining an indication of an actual resonance frequency of that electric-based antenna within the deployment environment, and removing one or more of the parasitic capacitive elements so as to adjust the actual resonance frequency towards the desired resonance frequency.

It should also be noted that during the tuning process, depending on how the parasitic capacitive elements are formed, it may be possible to test the effect of the removal of the parasitic capacitive element prior to actually removing it. For example, it may be possible to bend a parasitic capacitive element so as to move it out of the plane containing the electric field between the radiator element and the antenna ground plane, so as to effectively remove the capacitive effect of that parasitic element. The effect that that then has on the resonance frequency can be observed, before a decision is taken as to whether to finally remove that parasitic capacitive element or not.

Particular examples will now be described with reference to the Figures.

FIG. 1 schematically illustrates an electric-based antenna in accordance with a first example configuration, such an electric-based antenna also being referred to as a resonant antenna. In the design shown in FIG. 1, the antenna is arranged as an inverted-F antenna (IFA) where the F shape is formed by the features 10, 30, 40. The element 10 is a conductor forming a radiator element of the antenna, and is shorted to the ground plane 20 via a shorting pin 30 provided at one end of the radiator element. A feed element 40 extends from the radiator element towards the ground plane 20, so that the feed to the antenna is connected to an intermediate point along the length of the radiator element located near the shorting location 30. Such an antenna design enables a shorter and more compact design than a simple monopole antenna, and the impedance matching can be controlled by the designer without the need for extraneous matching components.

The electric field direction (i.e. the direction of the dominant component of the electric field) extends between the radiator element 10 and the ground plane 20, as indicated by the bidirectional arrow 60 in FIG. 1. In the design shown in FIG. 1, the IFA can be viewed as being a planar IFA (PIFA) since the radiator element is provided so as to be coplanar with the ground plane 20, such that the electric field also extends within the plane occupied by the ground plane 20. This provides a particularly compact and efficient design.

Furthermore, in the example shown in FIG. 1, it is assumed that the ground plane 20 is formed by a conductive sheet, for example a metal sheet, which can be of any suitable arbitrary shape but for the purposes of illustrative example may be considered to be an essentially rectangular sheet of metal. Each of the elements 10, 30, 40 may be formed from the same conductive sheet, hence reducing the number of individual components, for example by avoiding the need for any support structure for the radiator element.

As will be discussed in more detail herein, in accordance with the design shown in FIG. 1 a number of parasitic capacitive elements 50 (also referred to herein as stubs) are provided that extend from the ground plane 20 towards the radiator element 10, the tip of each of the stubs being separated from the radiator element by a predetermined gap. The gaps between the end of each stub and the radiator element 10 create parasitic capacitances, which serve to reduce the resonance frequency of the radiator element. The amount by which the resonance frequency is decreased will depend on the number of stubs 50 and the separation between the end of the stubs and the radiator element 10. The stubs can be provided in a variety of ways, but in one particular implementation are formed out of the same conductive sheet that is used to provide the ground plane 20. Hence, it can be seen that in such an embodiment, the ground plane 20, the radiator element 10, the feed pin 40, the grounding pin 30, and the stubs 50 all lie within the same plane, and all can be constructed from the same single conductive sheet, providing a very simple and space efficient design.

By providing the stubs 50, the resonance frequency of the antenna can be reduced to a level where it is known that the resonance frequency will be below the desired resonance frequency when the antenna is integrated within its intended deployment environment. Accordingly, once the antenna has been located within the deployment environment, the operational characteristics of the antenna can be observed, in order to derive an indication of the actual frequency response of the antenna when located within the deployment environment. Thereafter, one or more of the stubs 50 can be removed so as to adjust the actual frequency response, such that the actual resonance frequency is adjusted towards the desired resonance frequency. In particular, as the stubs are removed, the resonance frequency will increase, and by appropriate selection of the number of stubs to be removed, and the location of those stubs that are removed, the resonance frequency of the antenna can be tuned so as to raise that resonance frequency towards the desired resonance frequency of the antenna. This provides a great deal of flexibility in the tuning of the antenna post deployment.

In many modern devices that incorporate one or more antennas, the layout of the components within those devices may be arranged to be as compact as possible, meaning that many other components and structural features of the device may lie in close proximity to the antenna. Each of these components and structural features can affect the resonance frequency of the antenna, but it has been found that by providing a suitable number of stubs 50 and selectively removing those stubs, significant adjustments in the resonance frequency of the antenna can be made in situ, hence enabling a compensation to be made for the effects caused by adjacent components and structural features of the device. Indeed, considering the default resonance frequency that may be observed when all of the stubs are in place, in some example deployments that resonance frequency may be increased by between 40 and 50 percent when all of the stubs are removed.

Figure 2:
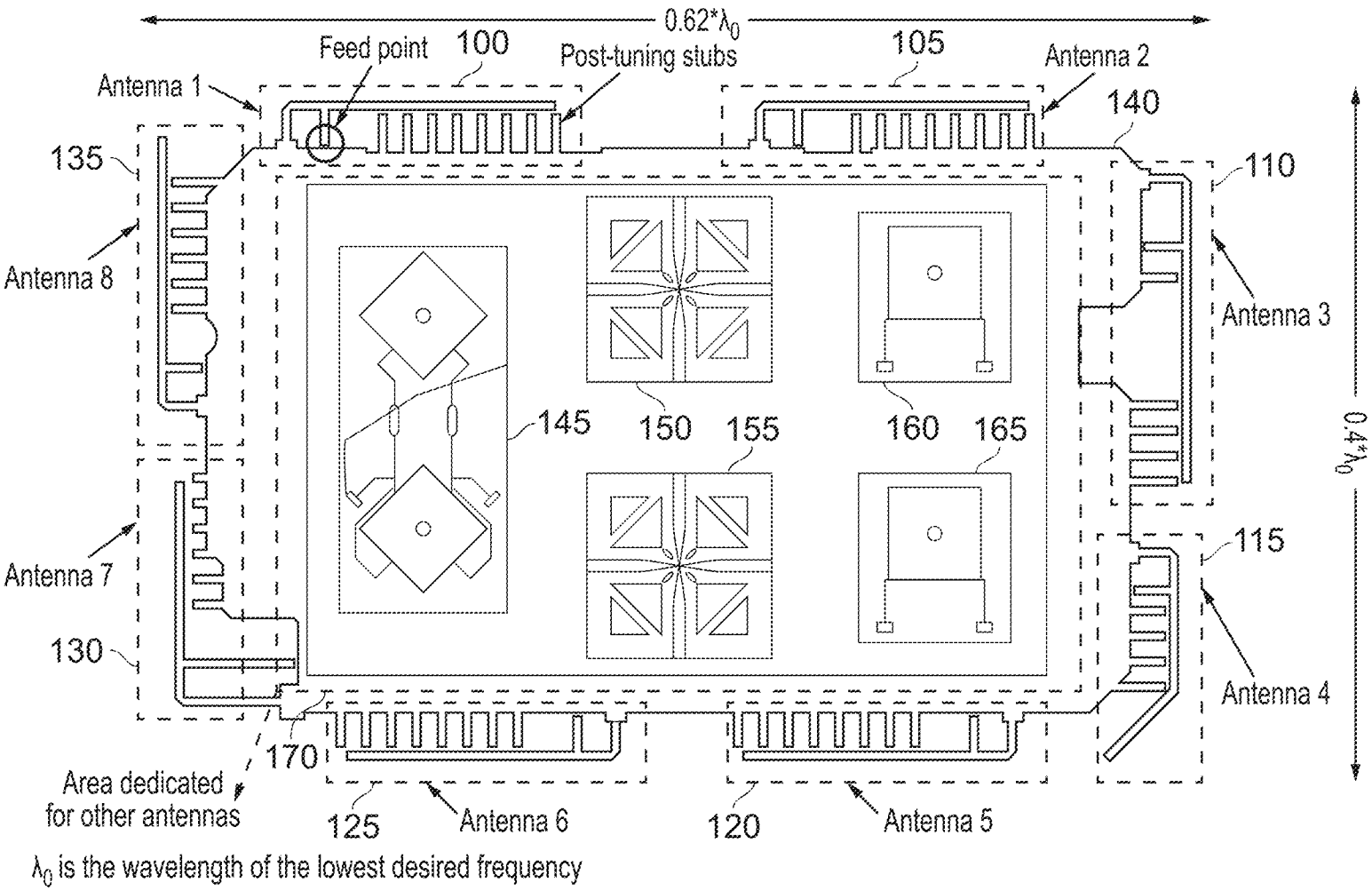
FIG. 2 illustrates how a plurality of instances of the antenna of FIG. 1 may be provided around the periphery of a common antenna ground plane, in accordance with one example configuration.

Due to the compact design of the antenna shown in FIG. 1, multiple such antennas can be provided that are all coupled to the same ground plane. Such an arrangement is shown in FIG. 2 where eight such antennas 100, 105, 110, 115, 120, 125, 130, 135 are located around the peripheral edge of a metal sheet 140 forming a common ground plane. As can be seen from FIG. 2, each of the individual antennas is arranged as an inverted-F antenna generally in accordance with the design shown in FIG. 1. However, the dimensions of each of the antennas need not be identical, and indeed each of the antennas can be formed taking into account the shape of the conductive sheet in the location where the antenna is to be formed. Hence, as shown in FIG. 2, the lengths of the radiator elements do not all need to be identical, the lengths of the feed pin and shorting pin may vary, and the length and number of the stubs may vary. With regards to the parasitic capacitance introduced by the stubs, it should be noted that the capacitance is governed by the distance between the end of each stub and the associated radiator element rather than the length of the stub itself, and hence the stubs can be formed taking into account the underlying shape of the conductive sheet. This can be seen particularly in regard of antenna 7 130 where not all of the stubs have the same length, due to the particular shape of the conductive sheet 140 in that area.

By positioning the antennas around the peripheral edge of a generally rectangular sheet as shown in FIG. 2, it is possible to form two different groups of antennas, where the antennas in one group have their electric fields extending in a particular direction, and the antennas in the other group have their electric fields extending in a perpendicular direction to the direction of the antennas in the first group. Hence, whilst all eight of the antennas 100, 105, 110, 115, 120, 125, 130, 135 have their electric fields within the plane of the conductive sheet 140, the antennas 100, 105, 120, 125 form a first group that are polarised in one direction whilst the antennas 110, 115, 130, 135 form a second group that are polarised in a perpendicular direction, such that the antennas of the second group are orthogonal to the antennas of the first group. This can increase the flexibility in how the antennas are used within the device, and can help to obtain more space diversity performance from the antenna system.

Further, since the electric field of all of the eight antennas is coplanar with the ground plane formed by the conductive sheet 140, those eight antennas can exist in co-habitation with other types of antennas that may also be provided within the device, and which may also make use of the antenna ground plane. Such additional antennas are illustrated schematically by the patterns 145, 150, 155, 160, 165 shown in FIG. 2, which use the area 170 of the conductive sheet 140 to form their ground planes. Those antennas may be arranged to operate with a low level of coupling with respect to the eight antennas 100, 105, 110, 115, 120, 125, 130, 135. This is made possible by the placing of the feed points of each of the eight antennas around the edge of the conductive sheet 140 so as to be in the same plane as the ground plane.

Not all of the eight antennas shown around the edge of the conductive sheet 40 need to be arranged to operate at the same desired resonance frequency. Hence there is a great deal of flexibility in the number of antennas provided, and the frequencies with which each of those antennas is desired to operate. However, with the particular eight antenna design of FIG. 2, it has been found that a very efficient design in terms of the space requirements can be provided, in particular the design shown in FIG. 2 having an area of $0.62x\lambda_0$ by $0.4x\lambda_0$ The particular wavelength $\lambda_0$ is dependent on the desired resonance frequency of the various antennas. Where not all of the antennas share the same desired resonance frequency, then the wavelength that defines the area requirement is the wavelength of the lowest desired resonance frequency amongst the antennas being provided around the periphery of the metallic sheet 140.

As shown in FIG. 2, not all of the antennas need to be provided with the same number of stubs, and the number of stubs provided may be chosen dependent on various factors, such as the desired level of adjustment in respect of the resonance frequency. However, purely by way of example, it has been found that when eight stubs are initially provided, then it is possible to adjust the resonance frequency by approximately 43 percent in one particular example deployment, as will be discussed in more detail later with reference to FIGS. 4A to 4C. This provides a very large degree of flexibility in the adjustment of the resonance frequency.

As will be apparent from the design shown in FIG. 2, all of the IFA antennas can share the same ground plane, and can be formed without needing any additional printed circuit board materials, which makes the design very cost effective. In particular, all of the features of the antennas can be formed directly from the metallic sheet 140 used to provide the ground plane.

Figure 3:
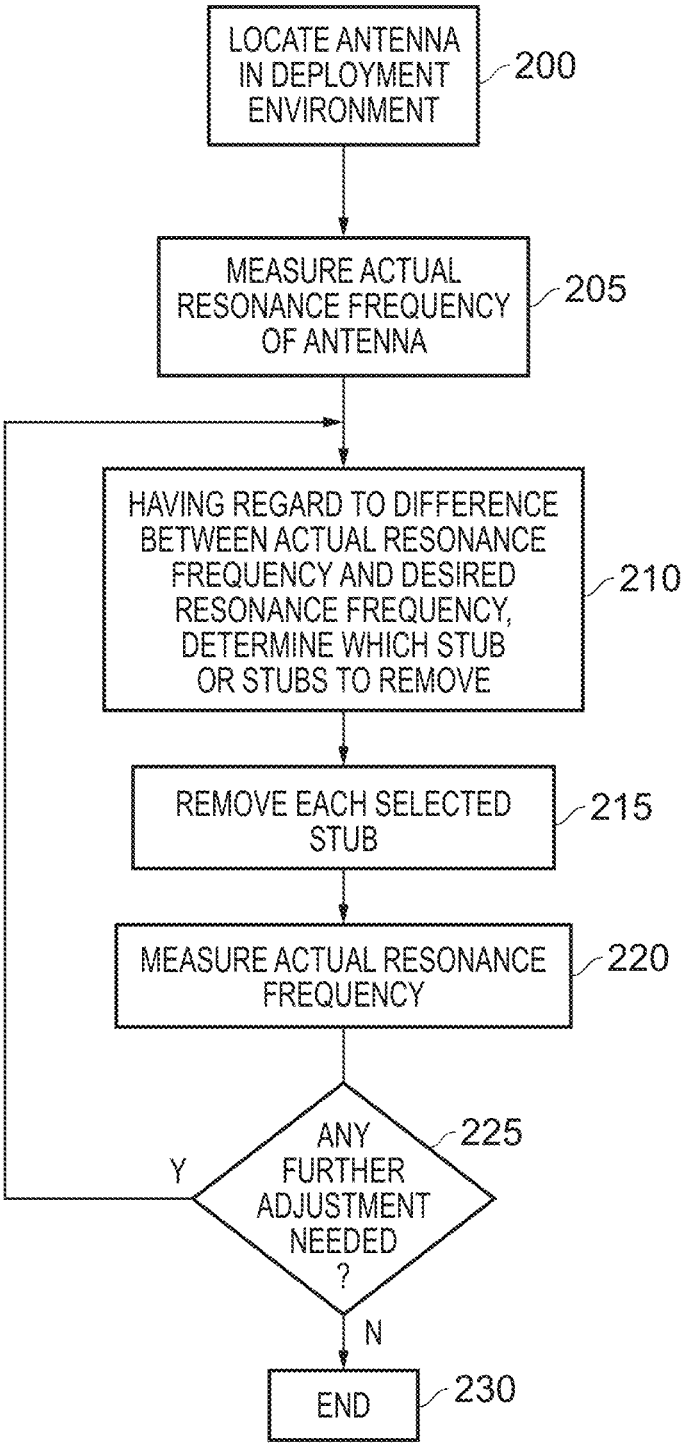
FIG. 3 is a flow diagram illustrating a method performed in accordance with one example to tune the resonance frequency of an electric-based antenna such as shown in FIG. 1.

FIG. 3 is a flow diagram illustrating a process that can be employed in respect of each of the antennas 100 through 135 shown in FIG. 2, in order to tune the resonance frequency of each antenna. At step 200, the antenna is located in its intended deployment environment. Hence, considering the FIG. 2 example, the conductive sheet 140 including each of the initial antenna designs shown in FIG. 2 can be located within the device that will utilise those antennas. Hence, the conductive sheet 140 will be located at its desired position within the device housing, and will be surrounded by all of the other components to be provided within the device, to thereby define the deployment environment. Once this has been done, then at step 205 the actual resonance frequency of the antenna can be measured. It will be appreciated that there are a number of different ways of measuring the resonance frequency, but as one example this can be observed by measuring S-parameter values at a range of different frequencies. As will be understood by those skilled in the art, the S-parameter value provides a ratio of the reflected power to the injected power, and hence can provide an indication of how efficiently power is transferred from the source to the antenna. For any particular antenna design, the antenna design will typically operate most efficiently at the resonance frequency, and hence the resonance frequency can be determined by observing how the S-parameter value varies as the frequency is changed.

Once an indication of the actual resonance frequency of the antenna has been obtained at step 205, then at step 210 the difference between the actual resonance frequency and the desired resonance frequency can be determined, and on that basis it can be decided whether to remove one or more stubs in order to seek to increase the resonance frequency. As will be discussed later with reference to FIGS. 4A to 4C, both the number of stubs removed, and the location of the stubs that are removed relative to the feed point, will have an effect on how the resonance frequency changes, and accordingly a decision as to which stub or stubs to remove can be taken based on the difference between the actual resonance frequency and the desired resonance frequency.

At step 215, the selected one or more stubs can then be removed. However, in one example deployment, the thickness and composition of the metal sheet 140 is such that the individual stubs can be bent at their base point where they connect to the conductive sheet prior to them being completely removed, so as to enable the stubs to effectively be moved out of the electric field plane of the antenna, to thereby enable the effect of a stub's removal to be observed before the stub is actually finally removed. Accordingly, in such an example arrangement, at step 215 the selected stubs may be bent as described above, but not yet physically removed.

At step 220, the actual resonance frequency can then be measured again, to take account of the stubs removed, or displaced, at step 215. As a result, it can then be determined at step 225 whether any further adjustment is needed, and if so the process can return to step 210. However, once the actual resonance frequency is considered close enough to the desired resonance frequency, the process can then end at step 230. If the stubs have not yet been removed at step 215, they can then be removed at step 230.

This process can be repeated in turn for each of the antennas within the design, and hence for example for each of the eight individual antennas shown in FIG. 2.

Figure 4A:
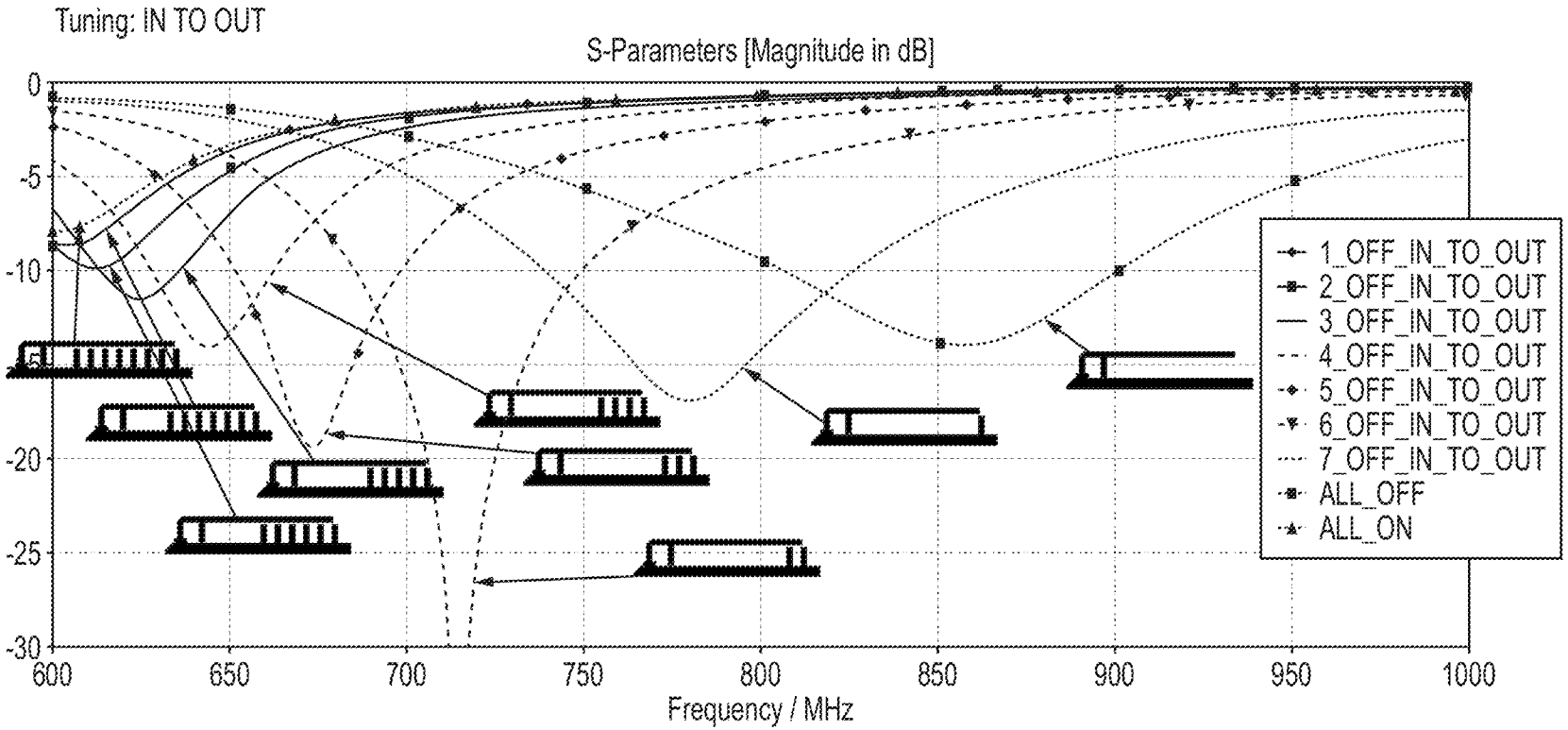
FIGS. 4A to 4C are graphs schematically illustrating how the resonance frequency may be tuned by removal of one or more stubs of the antenna, in accordance with an example arrangement.
Figure 4B:
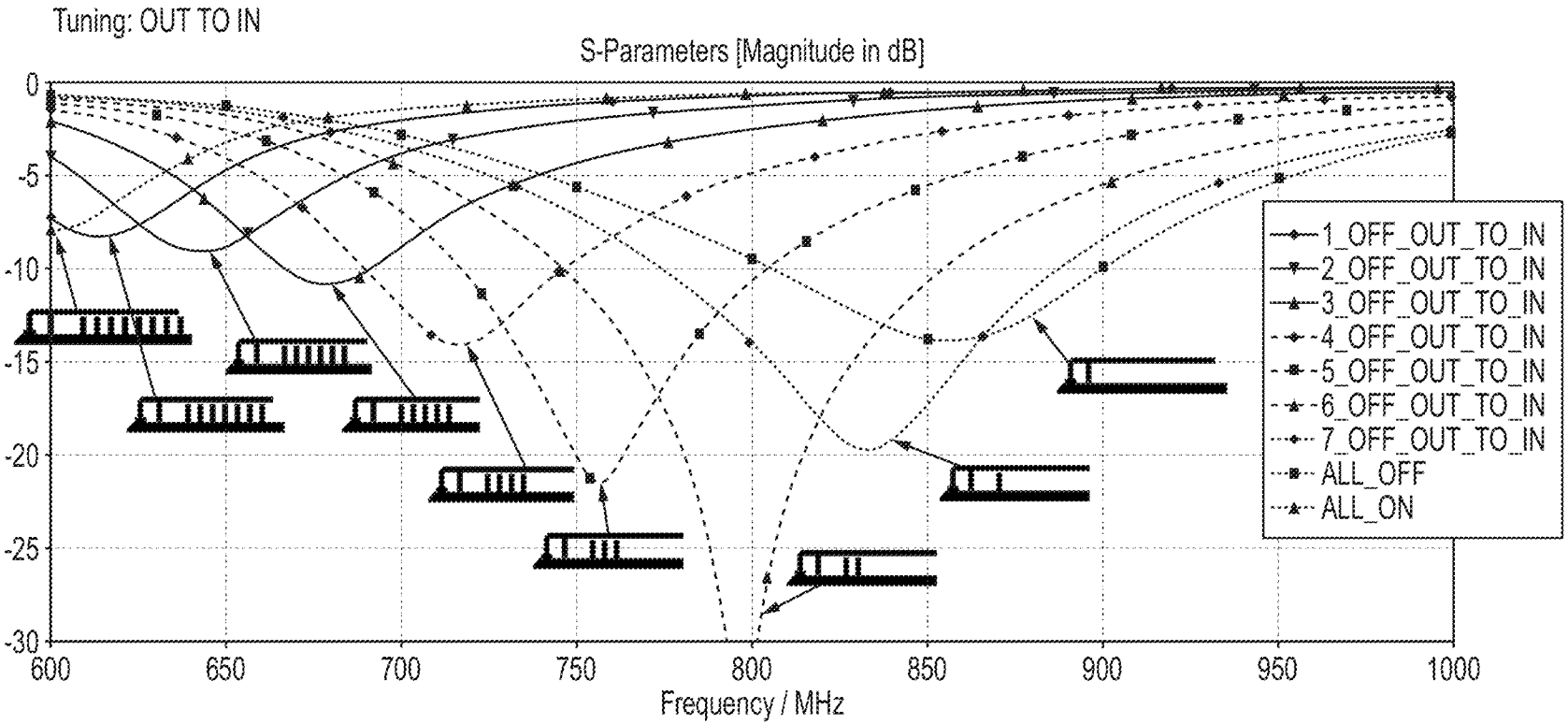
Figure 4C:
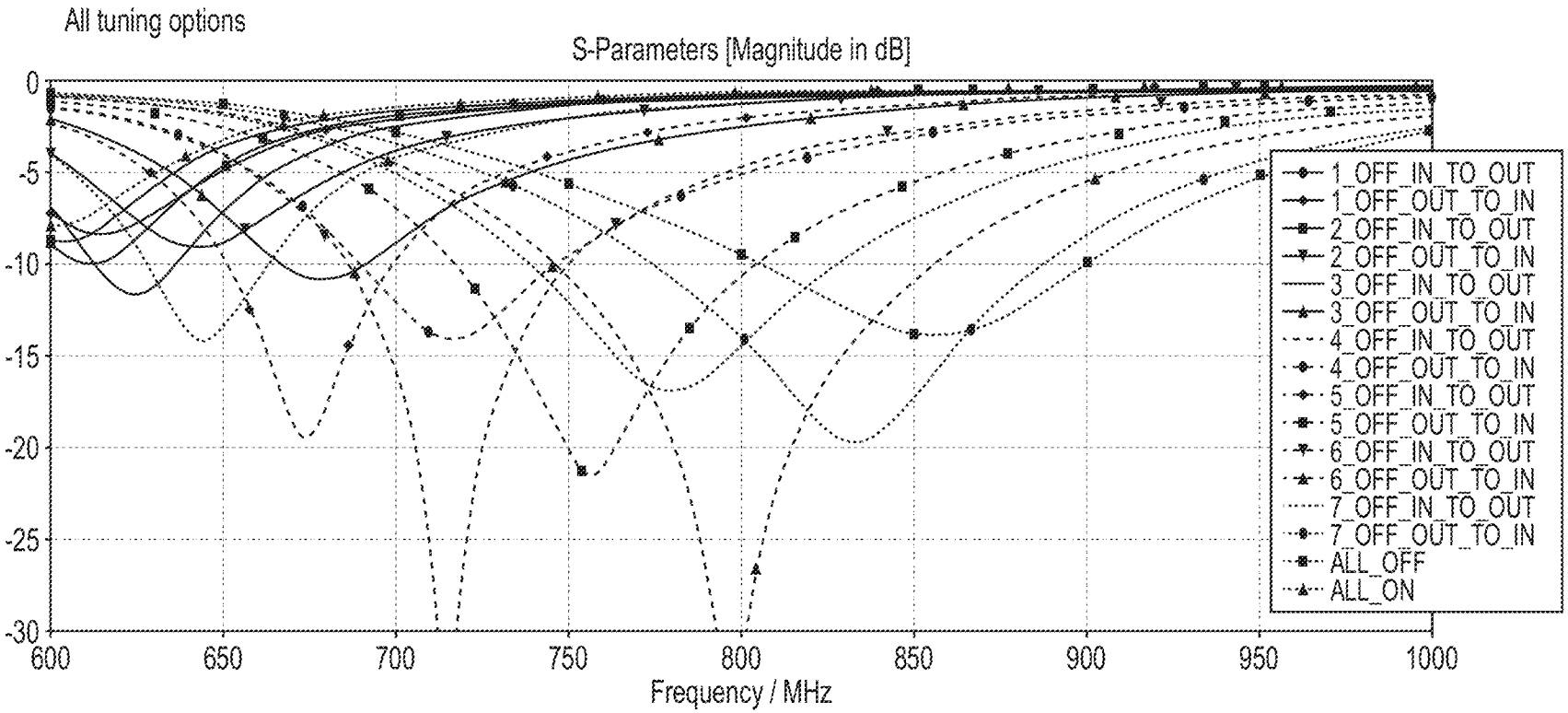

FIGS. 4A to 4C schematically illustrate the effect on resonance frequency of removing various stubs within an antenna according to the above discussed design. By way of illustrative example when referring to FIGS. 4A to 4C, it will be assumed that the matching level of the antenna is chosen to be −6 dB, and hence the antenna is assumed to be operational when the S-parameter value is more negative than −6 dB.

When removing stubs, it can be decided to remove the stubs starting from the innermost stub (i.e. the stub closest to the feed point) and proceeding to the outermost stub, such as illustrated in FIG. 4A, or instead to start with removal of the outermost stub (i.e. the one most remote from the feed point) and proceed inwards as shown in FIG. 4B. Of course, there is no requirement to restrict the removal of stubs to either pattern of removal, and if desired any individual stub can be removed. However, for the purposes of the following discussion, it will be assumed that removal starts from the innermost stub and proceeds to the outermost stub, as shown in FIG. 4A, or starts from the outermost stub and proceeds to the innermost stub, as shown in FIG. 4B.

Considering FIG. 4A first, the S-parameter curves for each of the stub configurations of the antenna are shown for a specific example case. In this example case, it is assumed that with all stubs in place the resonance frequency is approximately 600 MHz. It is also assumed that this is always less than the desired resonance frequency of the antenna, and accordingly it will be desired to remove one or more stubs in order to seek to increase the resonance frequency. As is clearly shown in FIG. 4A, as each stub is removed in turn, starting from the innermost stub, the trough in the S-parameter value moves to a higher frequency. The location of the trough indicates the position at which the antenna is working most efficiently, and hence provides an indication of the resonance frequency of the antenna. Accordingly, as each stub is removed, the resonance frequency increases.

As is apparent from FIG. 4A, as stubs are initially removed, the resonance frequency is adjusted in relatively fine increments, but as the later stubs are removed, the adjustments become more and more coarse, representing significant changes in the resonance frequency.

FIG. 4B models the same process, but assuming the stubs are removed starting with the outermost stubs and moving towards the innermost subs. Again, it can be seen that as each stub is removed, the resonance frequency increases. However, compared with FIG. 4A, the changes in the resonance frequency as each stub is removed are more uniform.

As mentioned earlier, in one example the matching level may be assumed to be −6 dB such that the antenna is operational whenever the S-parameter value is below −6 dB. As is evident from FIGS. 4A and 4B the effective frequency range of operation of the antenna gets larger as the resonance frequency increases.

FIG. 4C illustrates all of the tuning options represented by the examples of FIGS. 4A and 4B, and illustrates that there is a significant degree of flexibility in the adjustment of the resonance frequency of the antenna by removal of the appropriate stubs. In the particular example use case shown in FIG. 4C, it can be seen that the overall operational frequency range of the antenna can be adjusted from 600 MHz (it being assumed that the antenna does not need to operate below 600 MHz) to 940 MHz (assuming the −6 dB matching level), giving a variation in operational frequency of 340 MHz. With regards to the variation in the resonance frequency, then with all stubs in place the resonance frequency is in this case 600 MHz, but with all of the stubs removed the resonance frequency is approximately 860 MHz. Hence, it can be seen that in this particular use case the resonance frequency can be increased by approximately 43 percent by removal of all of the stubs, but can also be adjusted to a number of points in between based on the exact number and placement of the stubs that are removed.

Due to the operational range of frequencies of the antenna with particular stubs removed, it will be appreciated that there is no need to adjust the actual resonance frequency of the antenna so that it exactly matches the desired resonance frequency, and instead, provided that the actual resonance frequency is adjusted so that it is close enough to the desired resonance frequency, the antenna will observe good operational characteristics for the frequencies of interest.

Whilst in the above described process, the adjustments in the resonance frequency are made solely through removal of one or more stubs, if desired a further level of adjustment towards higher frequencies can be made by reducing the length of the radiator element. This could for example provide a final, finer, level of adjustment if desired. However, it has been found that often such an additional step will not be necessary, provided that a suitable number of stubs are provided within the design, to give the desired level of adjustment of the resonance frequency.

Once the above described tuning process has been applied in respect of each antenna, and hence the desired stubs have been removed, then the resulting design can be used as the final design for manufacturing many instances of the device. In the final manufactured device, there will then be a number of antennas, where each antenna may still have one or more stubs in place to influence the frequency of the associated antenna.

In addition to the finally manufactured devices that incorporate antennas that have been tuned by the above described process, another article that can be manufactured is the original arrangement of antennas that share a common ground plane, and that can be subjected to the above described tuning process in order to remove one or more stubs from the various antennas so as to tune their resonance frequency. Hence, by way of example, the conductive sheet with associated antennas shown in FIG. 2 may be produced for insertion into the desired device during a development stage, with the tuning process then being used to remove stubs as required from the individual antennas so as to tune their resonance frequencies. Following that design process, it would then be possible to proceed to full manufacture of the device, where at the time of manufacture each of the individual antennas is only produced with the required number of stubs.

Whilst for the purposes of illustration, it is assumed that the proposed antenna system is designed to operate and be tuned at sub-GHz frequencies, for example starting at approximately 650 MHz, the same principle can be applied to other antenna system designs, for example those operating at different frequencies.

By adopting the techniques described herein, an antenna system can be manufactured without the need for additional printed-circuit-board (PCB) materials, and the tuning process can be performed purely mechanically, for example by hand without any additional tools.

In contrast to mechanical grinding or laser trimming, the tuning process described herein is more affordable in terms of staff or materials as it does not require extra tools or equipment. In addition, there is not any chemical process engaged in the tuning operation, which can also provide a more efficient and safe manufacturing process. Moreover, this way of tuning will allow people with some disabilities (e.g. those not allowed to use sharp tools) to be able to work on this type of process.

A further advantage of the techniques described herein is the ability to control the tuning steps by choosing the direction of the removal of the stubs. Further a high tuning capability can be provided due to the high number of stubs that can be added to the ground plane along the radiator length.

Furthermore, the shared ground plane can serve as reflector to other high frequencies antennas, as for example shown in FIG. 2 in the filing application.

Although particular embodiments have been described herein, it will be appreciated that the invention is not limited thereto and that many modifications and additions thereto may be made within the scope of the invention. For example, various combinations of the features of the following dependent claims could be made with the features of the independent claims without departing from the scope of the present invention.

The invention claimed is:

1. A method of tuning a resonance frequency of an electric-based antenna formed by a radiator element coupled to an antenna ground plane, comprising:

providing a plurality of parasitic capacitive elements extending in an electric field direction of the electric-based antenna so as to lower the resonance frequency of the electric-based antenna below a desired resonance frequency;

integrating the electric-based antenna within a deployment environment;

obtaining an indication of an actual resonance frequency of the electric-based antenna within the deployment environment; and removing, after integration into the deployment environment, one or more of the parasitic capacitive elements so as to increase the actual resonance frequency towards the desired resonance frequency.

2. A method as claimed in claim 1, wherein the plurality of parasitic capacitive elements provided is such that the removing step enables the resonance frequency to be increased by up to a chosen maximum percentage between a configuration with all of the parasitic capacitive elements remaining and a configuration within no parasitic capacitive elements remaining.

3. A method as claimed in claim 1, wherein the radiator element is shorted to the antenna ground plane at a shorting location, and each of the parasitic capacitive elements are positioned at different distances from the shorting location.

4. A method as claimed in claim 1, wherein the radiator element is formed so as to be co-planar with the antenna ground plane.

5. A method as claimed in claim 4, further comprising:

providing a feed point into the radiator element that is coplanar with the antenna ground plane.

6. A method as claimed in claim 4, wherein during the step of providing the plurality of parasitic capacitive elements, each parasitic capacitive element is formed so as to be coplanar with the antenna ground plane.

7. A method as claimed in claim 4, wherein the antenna ground plane is provided by a conductive sheet, and the radiator element and each parasitic capacitive element are formed from the conductive sheet.

8. A method as claimed in any claim 1, further comprising:

providing a plurality of electric-based antennas that each share the antenna ground plane and have an associated radiator element;

for each electric-based antenna, providing a plurality of parasitic capacitive elements extending in an electric field direction of that electric-based antenna so as to lower the resonance frequency of that electric-based antenna below a desired resonance frequency of that electric-based antenna; and on integrating the plurality of electric-based antennas within the deployment environment, the method comprising tuning the resonance frequency of each electric based antenna by, for each electric-based antenna:

obtaining an indication of an actual resonance frequency of that electric-based antenna within the deployment environment, and removing one or more of the parasitic capacitive elements of that electric-based antenna so as to adjust the actual resonance frequency towards the desired resonance frequency of that electric-based antenna.

9. A method as claimed in claim 8, wherein the radiator elements of the plurality of electric-based antennas are distributed around a peripheral edge of the antenna ground plane.

10. A method as claimed in claim 9, wherein the plurality of electric-based antennas form a first group of antennas and a second group of antennas, the first group having an electric field direction orthogonal to the electric field direction of the second group.

11. A method as claimed in claim 9, wherein the plurality of electric-based antennas comprise eight electric-based antennas, and an overall dimension of the eight electric-based antennas including the shared antenna ground plane is approximately $0.6x\lambda_0$ by $0.4x\ \lambda_0$, where $\lambda_0$ is a wavelength corresponding to a chosen resonance frequency.

12. A method as claimed in claim 9, further comprising employing the antenna ground plane as a ground plane for other antennas in addition to the plurality of electric-based antennas distributed around the peripheral edge of the antenna ground plane.

13. A method as claimed in claim 8, wherein at least one of the plurality of electric-based antennas has a desired resonance frequency that is different to the desired resonance frequency of at least one other of the plurality of electric-based antennas.

14. A method as claimed in claim 1, wherein the electric-based antenna is a metallic inverted-F antenna.

15. A method as claimed in claim 1, further comprising reducing the length of the radiator element in combination with removal of one or more of the parasitic capacitive elements when adjusting the actual resonance frequency towards the desired resonance frequency.

16. An apparatus comprising:

at least one electric-based antenna comprising a radiator element coupled to an antenna ground plane, the antenna ground plane being shared with each electric-based antenna;

each electric-based antenna being provided with a plurality of parasitic capacitive elements extending in an electric field direction of that electric-based antenna so as to lower the resonance frequency of that electric-based antenna below a desired resonance frequency;

wherein each of the plurality of parasitic capacitive elements is individually removable such that, when the apparatus is integrated within a deployment environment, a method of tuning each electric-based antenna may be performed by obtaining an indication of an actual resonance frequency of that electric-based antenna within the deployment environment, and removing, after the apparatus is integrated within the deployment environment, one or more of the parasitic capacitive elements so as to increase the actual resonance frequency towards the desired resonance frequency.

* * * * *